US008304152B2

(12) United States Patent
Wu

(10) Patent No.: US 8,304,152 B2
(45) Date of Patent: Nov. 6, 2012

(54) SPIRODILACTAM POLYCARBONATE CONTAINING PHOTOCONDUCTORS

(75) Inventor: Jin Wu, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 245 days.

(21) Appl. No.: 12/846,023

(22) Filed: Jul. 29, 2010

(65) Prior Publication Data

US 2012/0028180 A1 Feb. 2, 2012

(51) Int. Cl.
*G03G 5/047* (2006.01)
*G03G 5/05* (2006.01)

(52) U.S. Cl. ..... 430/58.8; 430/59.6; 430/96; 430/58.75

(58) Field of Classification Search ..... 430/59.6, 430/96, 58.8, 58.75
See application file for complete search history.

(56) References Cited

U.S. PATENT DOCUMENTS

| | | | | |
|---|---|---|---|---|
| 4,906,725 | A | 3/1990 | Wang | |
| 5,030,707 | A | 7/1991 | Wang | |
| 5,095,088 | A | 3/1992 | Want | |
| 5,128,436 | A * | 7/1992 | Wang | 528/96 |
| 5,521,306 | A | 5/1996 | Burt et al. | |
| 6,080,833 | A * | 6/2000 | Otsuji et al. | 528/201 |
| 6,913,863 | B2 | 7/2005 | Wu et al. | |
| 2005/0106483 | A1 * | 5/2005 | Shoshi et al. | 430/58.7 |
| 2006/0105254 | A1 | 5/2006 | Wu et al. | |

OTHER PUBLICATIONS

Zhou, Hui et al. "New spirodilactam polymers" Polymer (vol. 47), pp. 6927-6930 (2006).*
Jin Wu et al., U.S. Appl. No. 12/644,071 on Polyalkylene Glycol Benzoate Containing Photoconductors, filed Dec. 22, 2009.
Jin Wu, U.S. Appl. No. 12/768,873 on Dendritic Polyester Polyol Photoconductors, filed Apr. 28, 2010.
Jin Wu et al., U.S. Appl. No. 12/550,498 on Plasticizer Containing Photoconductors, filed Aug. 31, 2009.
Robert C.U. Yu et al., U.S. Appl. No. 12/471,311 on Flexible Imaging Members Having a Plasticized Imaging Layer, filed May 22, 2009.
Robert C.U. Yu et al., U.S. Appl. No. 12/434,572 on Flexible Imaging Members Without Anticurl Layer, filed May 1, 2009.

* cited by examiner

*Primary Examiner* — Christopher Rodee
(74) *Attorney, Agent, or Firm* — Eugene O. Palazzo

(57) ABSTRACT

A photoconductor that includes a supporting substrate, an optional ground plane layer, an optional hole blocking layer, an optional adhesive layer, a photogenerating layer, and at least one charge transport layer, and where the charge transport layer contains a spirodilactam based polycarbonate.

32 Claims, No Drawings

SPIRODILACTAM POLYCARBONATE CONTAINING PHOTOCONDUCTORS

CROSS REFERENCE TO RELATED APPLICATIONS

Copending U.S. application Ser. No. 12/644,071, filed Dec. 22, 2009, the disclosure of which is totally incorporated herein by reference, illustrates a photoconductor that includes a supporting substrate, an optional ground plane layer, an optional hole blocking layer, a photogenerating layer, and at least one charge transport layer, and where the charge transport layer contains a polyalkylene glycol benzoate.

Illustrated in copending U.S. application Ser. No. 12/768,873, filed Apr. 28, 2010, the disclosure of which is totally incorporated herein by reference, is a photoconductor comprising a substrate, and an undercoat layer thereover comprised of a metal oxide and a mixture of a phenolic resin and a dendritic polyester polyol; a photogenerating layer; and a charge transport layer.

U.S. application Ser. No. 12/550,498, filed Aug. 31, 2009, the disclosure of which is totally incorporated herein by reference, illustrates a photoconductor comprising a substrate, a photogenerating layer, and a charge transport layer, and wherein the charge transport layer contains a cyclohexanedicarboxylate, such as diisononyl cyclohexanedicarboxylate.

U.S. application Ser. No. 12/471,311, filed May 22, 2009, the disclosure of which is totally incorporated herein by reference, illustrates a flexible imaging member comprising a flexible substrate; a charge generating layer disposed on the substrate; and at least one charge transport layer disposed on the charge generating layer, wherein the charge transport layer comprises a polycarbonate, N,N'-diphenyl-N,N'-di(3-methylphenyl)-1,1-biphenyl-4,4'-diamine, a first plasticizer or a second plasticizer, and further wherein the first plasticizer and the second plasticizer are miscible with both the polycarbonate and N,N'-diphenyl-N,N'-di(3-methylphenyl)-1,1-biphenyl-4,4'-diamine.

U.S. application Ser. No. 12/434,572, filed May 1, 2009, illustrates an imaging member comprising a substrate; a charge generating layer disposed on the substrate; and at least one charge transport layer disposed on the charge generating layer, wherein the charge transport layer comprises a polycarbonate, a charge transport compound of N,N'-diphenyl-N,N'-bis(3-methylphenyl)-1,1-biphenyl-4,4'-diamine, and a liquid compound having a high boiling point, and further wherein the liquid compound is miscible with both the polycarbonate and N,N'-diphenyl-N,N'-bis(3-methylphenyl)-1,1-biphenyl-4,4'-diamine.

Examples of plasticizers illustrated in the appropriate above copending applications are, for example, dioctyl phthalate, diallyl phthalate, liquid styrene dimer, and others as illustrated by the structure/formulas disclosed.

High photosensitivity titanyl phthalocyanines are illustrated in copending U.S. application Ser. No. 10/992,500, U.S. Publication No. 20060105254, which, for example, discloses a process for the preparation of a Type V titanyl phthalocyanine, comprising providing a Type I titanyl phthalocyanine; dissolving the Type I titanyl phthalocyanine in a solution comprising a trihaloacetic acid and an alkylene halide like methylene chloride; adding the resulting mixture comprising the dissolved Type I titanyl phthalocyanine to a solution comprising an alcohol and an alkylene halide thereby precipitating a Type Y titanyl phthalocyanine; and treating the Type Y titanyl phthalocyanine with monochlorobenzene to yield a Type V titanyl phthalocyanine.

A number of the components of the above cross referenced applications, the disclosures of each being totally incorporated herein by reference in their entireties, such as the appropriate supporting substrates, resin binders, antioxidants, charge transport components, titanyl phthalocyanines, high photosensitivity titanyl phthalocyanines, such as Type V, hydroxygallium phthalocyanines, chlorogallium phthalocyanines, adhesive layers, and the like, may be selected for the photoconductors and imaging members of the present disclosure in embodiments thereof.

BACKGROUND

This disclosure is generally directed to layered imaging members, photoreceptors, photoconductors, and the like that can be selected for a number of systems, such as copiers and printers, especially xerographic copiers and printers inclusive of digital printers, and printers that generate color xerographic documents, and which printers can be selected for the office environment, and for production and commercial uses. More specifically, the present disclosure is directed to multilayered drum, or flexible belt imaging members or devices comprised of a supporting medium like a substrate; an optional ground plane layer, an optional hole blocking layer; a photogenerating layer; and a charge transport layer, including at least one or a plurality of charge transport layers, and wherein at least one charge transport layer is, for example, from 1 to about 7, from 1 to about 3, and one; and more specifically, a first charge transport layer and a second charge transport layer, and where a spirodilactam based polycarbonate, and yet more specifically, a first charge transport resin binder of a copolymer of a spirodilactam polycarbonate and a polycarbonate together with a second polycarbonate. The spirodilactam based polycarbonates containing photoconductors possess, in embodiments, excellent wear characteristics, and where the spirodilactam based polycarbonates function, for example, as a charge transport layer (CTL) first or second resin binder, and an additional binder of, for example, a polycarbonate.

Yet more specifically, an advantage of the photoconductors, in embodiments of the present disclosure, is that the wear rates when selecting for the charge transport layer a spirodilactam based polycarbonate was, for example, about 38 nanometers/kilocycle, about 40 percent less than that of a charge transport layer (CTL) with no spirodilactam based polycarbonates, where the wear rate is about 58 nanometers/kilocycle.

The photoconductors disclosed herein possess a number of advantages especially in xerographic processes and xerographic printers, such as, in embodiments, the minimal wearing of the charge transport layer or layers; the minimization or substantial elimination of undesirable ghosting on developed images, such as xerographic images, including decreased ghosting at various relative humidities; excellent cyclic and stable electrical properties; minimal charge deficient spots (CDS); compatibility with the photogenerating and charge transport resin binders; extended xerographic biased charge roller (BCR) wear characteristics and acceptable lateral charge migration (LCM) characteristics, such as for example, excellent LCM resistance.

Ghosting refers, for example, to when a photoconductor is selectively exposed to positive charges in a number of xerographic print engines, and where some of the positive charges enter the photoconductor and manifest themselves as a latent image in the subsequent printing cycles. This print defect can cause a change in the lightness of the half tones, and is commonly referred to as a "ghost" that is generated in the previous printing cycle. An example of a source of the positive charges is the stream of positive ions emitted from the transfer corotron. Since the paper sheets are situated between the transfer corotron and the photoconductor, the photoconductor is shielded from the positive ions from the paper sheets. In the areas between the paper sheets, the photoconductor is fully exposed, thus in this paper free zone the positive charges may enter the photoconductor. As a result, these charges cause a print defect or ghost in a half tone print if one switches to a larger paper format that covers the previous paper print free zone.

Excellent cyclic stability of the photoconductor refers, for example, to almost no or minimal change in a generated known photoinduced discharge curve (PIDC), especially no or minimal residual potential cycle up after a number of charge/discharge cycles of the photoconductor, for example about 100 kilocycles, or xerographic prints of, for example, from about 80 to about 100 kiloprints. Excellent color print stability refers, for example, to substantially no or minimal change in solid area density, especially in 60 percent halftone prints, and no or minimal random color variability from print to print after a number of xerographic prints, for example 50 kiloprints.

Also included within the scope of the present disclosure are methods of imaging and printing with the photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the toner image to a suitable image receiving substrate, and permanently affixing the image thereto. In those environments wherein the photoconductor is to be used in a printing mode, the imaging method involves the same operation with the exception that exposure can be accomplished with a laser device or image bar. More specifically, the flexible photoconductor belts disclosed herein can be selected for the Xerox Corporation iGEN® machines that generate with some versions over 100 copies per minute. Processes of imaging, especially xerographic imaging and printing, including digital and/or color printing, are thus encompassed by the present disclosure. The imaging members are, in embodiments, sensitive in the wavelength region of, for example, from about 400 to about 900 nanometers, and in particular from about 650 to about 850 nanometers, thus diode lasers can be selected as the light source. Moreover, the imaging members of this disclosure are useful in color xerographic applications, particularly high-speed color copying and printing processes inclusive of digital xerographic processes.

REFERENCES

There is illustrated in U.S. Pat. No. 6,913,863 a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

A number of layered photoconductors are known and have been described in numerous U.S. patents, and which patents disclose, for example, a photoconductor comprised of a supporting substrate, a photogenerating layer, and a charge transport layer and where the photogenerating layer and charge transport layer include certain resin binders, such as polycarbonates, polyesters, and the like.

Illustrated in U.S. Pat. No. 5,521,306 is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine which can be selected as a photoconductor photogenerating pigment. Processes for the generation of hydroxyl gallium phthlaocyanines are also illustrated in U.S. Pat. Nos. 5,482,811 and 5,473,064.

The appropriate components, such as the supporting substrates, the photogenerating layer components, the charge transport layer components, the overcoating layer components, and the like of the above-recited patents may be selected for the photoconductors of the present disclosure in embodiments thereof.

EMBODIMENTS

In aspects thereof of the present disclosure, there is illustrated a photoconductor comprising a supporting substrate, a photogenerating layer, and a charge transport layer, and wherein the charge transport layer contains a spirodilactam polycarbonate copolymer binder; a photoconductor comprised in sequence of a supporting substrate, a hole blocking layer thereover, an adhesive layer, a photogenerating layer, and a charge transport layer, and wherein the charge transport layer contains a charge transport component, a spirodilactam polycarbonate present in an amount of from about 1 to about 20 weight percent, and a polycarbonate present in an amount of from about 40 to about 65 weight percent; a photoconductor comprised of a photogenerating layer comprised of a photogenerating pigment, a hole blocking layer, an adhesive layer, and a charge transport layer, and wherein the charge transport layer is comprised of a charge transport component, a spirodilactam polycarbonate copolymer represented by

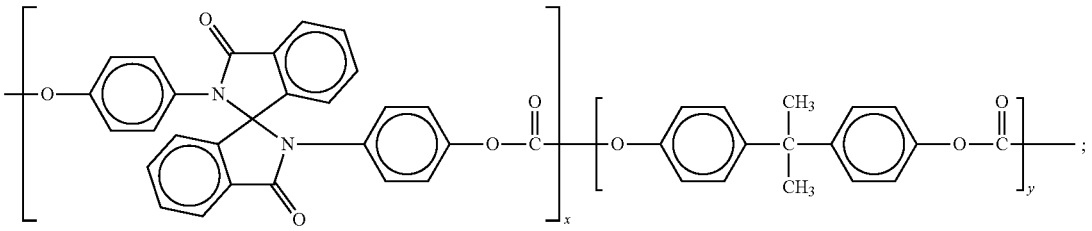

-continued

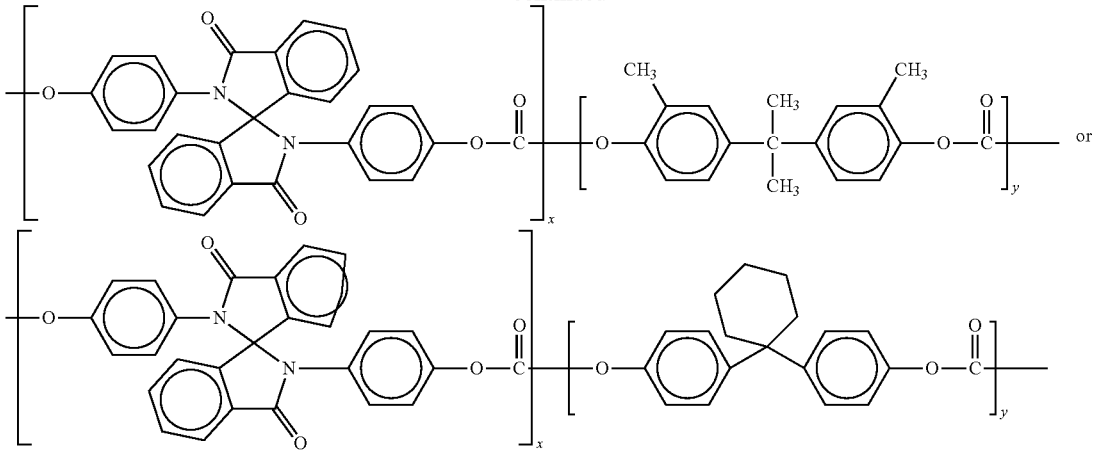

wherein x and y represent mole percents, and where the sum of x and y thereof is 100 mole percent, and a polycarbonate selected from the group consisting of poly(4,4'-dihydroxy-diphenyl-1-1-cyclohexane), poly(4,4'-isopropylidene-diphenyl) carbonate, and mixtures thereof; a photoconductor comprising a substrate, a photogenerating layer, and a charge transport layer, and wherein the charge transport layer contains a charge transport component, such as an aryl amine and other known charge and hole transport components, a resin binder, and a spirodilactam polycarbonate, such as those disclosed in U.S. Pat. Nos. 4,906,725; 5,030,707 and 5,095,088, the disclosures of which are totally incorporated herein by reference in their entireties; a photoconductor comprising a substrate, an undercoat layer thereover, a photogenerating layer, and at least one charge transport layer, and wherein the at least one charge transport layer in contact with the photogenerating layer contains a spirodilactam based polycarbonate present in an amount of from about 1 to about 80 weight percent, from 2 to about 50 weight percent, from about 3 to about 20 weight percent, and more specifically about 6 weight percent, a second resin binder, like a polycarbonate dissimilar than the spirodilactam polycarbonate present in an amount of from about 1 to about 80 weight percent, from about 20 to about 70 weight percent, from about 40 to about 60 weight percent, and more specifically about 54 weight percent; a photoconductor comprised in sequence of a photogenerating layer comprised of a photogenerating pigment, and a hole transport layer, and wherein the transport layer is comprised of a hole transport component, a polycarbonate and a copolymer of a spirodilactam polycarbonate and a polycarbonate; a photoconductor comprising a supporting substrate, a ground plane layer, a hole blocking layer, an adhesive layer, a photogenerating layer comprised of at least one photogenerating pigment, and a charge transport layer comprised of at least one charge transport component, and where the charge transport layer has incorporated therein a hole transport component, a polycarbonate, and a copolymer of a spirodilactam polycarbonate and a known polycarbonate, that is the same as the polycarbonate included in known charge transport layers; a flexible photoconductive member comprised in sequence of a supporting substrate, a ground plane layer, a hole blocking or undercoat layer, a photogenerating layer thereover comprised of at least one photogenerating pigment, and as a second binder for the charge transport layer a spirodilactam based polycarbonate; a photoconductor which includes a hole blocking layer and an adhesive layer where the adhesive layer is situated between the hole blocking layer and the photogenerating layer, and the hole blocking layer is situated between the supporting substrate layer, and the adhesive layer; a photoconductor comprising a supporting substrate, a hole blocking layer, a photogenerating layer, and at least one charge transport layer comprised of at least one charge transport component, and wherein a first pass charge transport layer is in contact with the photogenerating layer, and a second pass charge transport layer is in contact with the first charge transport layer, and the second top charge transport layer includes therein a spirodilactam based polycarbonate, a hole transport component, and a resin binder; a photoconductor comprising a supporting substrate, a photogenerating layer in contact with the supporting substrate, and at least one charge transport layer in contact with the photogenerating layer, and wherein at least one, such as 1, 2, or 3 charge transport layers, contains a polymer of a spirodilactam polycarbonate, and a polycarbonate as illustrated herein; a photoconductor comprised in sequence of a photogenerating layer comprised of a photogenerating pigment, such as a hydroxygallium phthalocyanine, a chlorogallium phthalocyanine or a titanyl phthalocyanine, a first charge transport layer, and a second charge transport layer thereover, and wherein the second charge transport layer is comprised of a charge transport component, a resin binder, a polycarbonate first resin binder, and as a second resin binder a copolymer of a spirodilactam polycarbonate and a polycarbonate; or where the second charge transport layer is comprised of a charge transport component, a resin binder, a first resin binder of a copolymer of a spirodilactam polycarbonate and a polycarbonate, and a second resin binder of polycarbonate Z, where the copolymer of a spirodilactam polycarbonate and a polycarbonate minimizes the wear of the charge transport layer; a photoconductor wherein the spirodilactam is 1,6-di(4-hydroxyphenyl)-1,6-diazoaspiro[4.4]nonane-2,7-dione, 1,6-di(4-hydroxyphenyl)-3,4,8,9-tetrafluoro-1,6-diazoaspiro[4.4]nonane-2,7-dione, 1,6-di(3-hydroxy-4-chlorophenyl)-3,3,4,4,8,8,9, or 9-octylmethyl-1,6 diazoaspiro[4.4]nonane-2,7-dione; and the polycarbonate binder is a poly(4,4'-dihydroxy-diphenyl-1-1-cyclohexane), a poly(4,4'-isopropylidene-diphenylene) carbonate, a poly(4,4'-cyclohexylidine diphenylene) carbonate, or a poly(4,4'-isopropylidene-3,3'-dimethyl-diphenyl) carbonate; and a photoconductor comprised of a photogenerating layer comprised of a photogenerating pigment, a hole blocking layer, an adhesive layer, and a charge transport layer, and wherein the charge transport layer is comprised of a charge transport component, a spirodilactam polycarbonate copolymer represented by

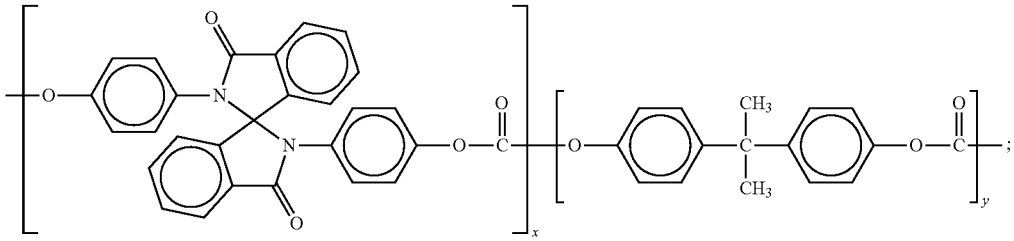

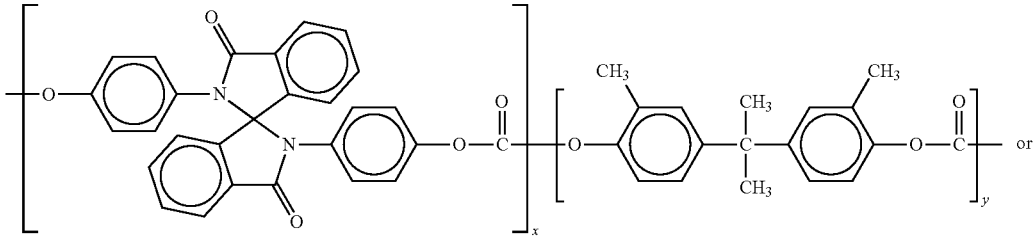

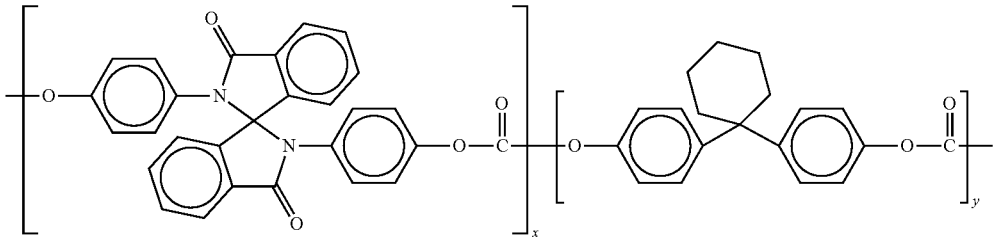

wherein x and y represent mole percents, and where the sum of x and y thereof is 100 mole percent, and a polycarbonate selected from the group consisting of poly(4,4'-dihydroxydiphenyl-1-1-cyclohexane), poly(4,4'-isopropylidene-diphenyl) carbonate, and mixtures thereof.

The photoconductors disclosed herein in embodiments include in the charge transport layer a copolymer of a spirodilactam polycarbonate and a polycarbonate as illustrated in U.S. Pat. Nos. 4,906,725; 5,030,707 and 5,095,088, the disclosures of which are totally incorporated herein by reference in their entireties, and more specifically, the copolymers of a spirodilactam polycarbonate and a polycarbonate, and yet more specifically, where the copolymer of a spirodilactam polycarbonate and a polycarbonate is represented, for example, by

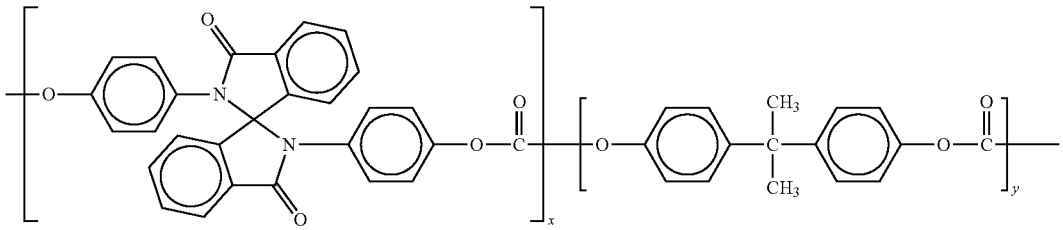

wherein x and y represent the mole percent, and more specifically, where x is from about 1 to about 30 mole percent (from about to about includes between about and about), from about 2 to about 20 mole percent, from about 1 to about 5 mole percent, from about 3 to about 10 mole percent, or other suitable mole percents, and y is, for example, from about 70 to 99 mole percent, from about 80 to about 98 mole percent, from about 99 to about 95 mole percent, from about 90 to about 97 mole percent, or other suitable mole percents, and with, for example, a weight average molecular weight of from about 10,000 to about 100,000, from about 20,000 to about 75,000, from about 35,000 to about 90,000 as determined by know analytic processes, such as by GPC, and where the copolymers of the referenced spirodilactam polycarbonate and polycarbonate are available from Shell Development Company, Houston, Tex.

In embodiments, specific examples of copolymers of spirodilactam polycarbonate and a polycarbonate can be represented by

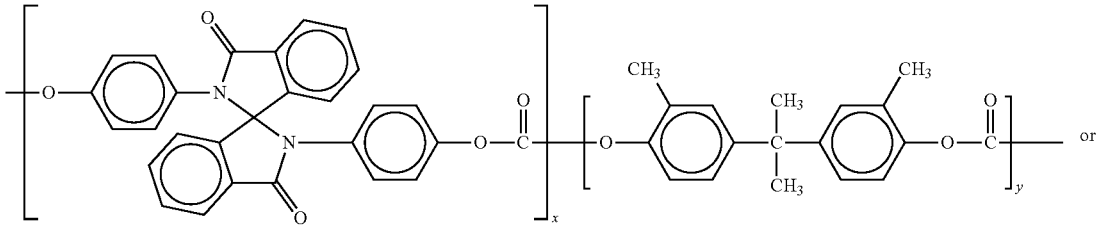

or

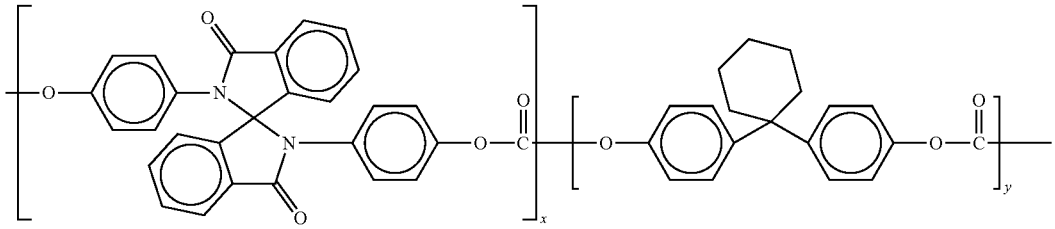

wherein x and y represent the mole percents of each segment in brackets, and more specifically, where x is, for example, from about 1 to about 30 mole percent (from about to about includes all values or numbers in between about and about), from about 2 to about 20 mole percent, or from about 3 to about 10 mole percent, and y is, for example, from about 70 to 99 mole percent, from about 80 to about 98 mole percent, or from about 90 to about 97 mole percent, and with, for example, a weight average molecular weight as illustrated here, such as for example, from about 10,000 to about 100,000.

Examples of spirodilactams are 1,6-di(4-hydroxyphenyl)-1,6-diazoaspiro[4.4]nonane-2,7-dione, 1,6-di(4-hydroxyphenyl)-3,4,8,9-tetrafluoro-1,6-diazoaspiro[4.4]nonane-2,7-dione, 1,6-di(3-hydroxy-4-chlorophenyl)-3,3,4,4,8,8,9, or 9-octylmethyl-1,6 diazoaspiro[4.4]nonane-2,7-dione; and examples of spirodilactam polycarbonate copolymers are a polycarbonate copolymer of a spirodilactam, and a bisphenol selected, for example, from the group consisting of bisphenol A and bisphenol Z, and said polycarbonate binder is a poly (4,4'-dihydroxy-diphenyl-1-1-cyclohexane, a poly(4,4'-isopropylidene-diphenylene) carbonate, a poly(4,4'-cyclohexylidine diphenylene) carbonate, a poly(4,4'-isopropylidene-3,3'-dimethyl-diphenyl) carbonate, or mixtures thereof.

The polycarbonate second resin binder and the polycarbonate selected for forming the spirodilactam polymer possesses, for example, a number average molecular weight ($M_n$) of, for example, from about 10,000 to about 80,000, or from about 20,000 to about 60,000, and a weight average molecular weight ($M_w$) of from about 20,000 to about 100,000, or from about 40,000 to about 80,000, where $M_w$ and $M_n$ were determined by Gel Permeation Chromatography (GPC). Specific examples of the second polycarbonate resin, a number of which are prepared, for example, from di(hydroxyphenyl) alkanes, such as 2,2-di(4-hydroxyphenyl)propane, are illustrated in U.S. Pat. No. 5,030,707, the disclosure of which is totally incorporated herein by reference, like PCZ-400 [poly (4,4'-dihydroxy-diphenyl-1-1-cyclohexane, $M_w$=40,000)] available from Mitsubishi Gas Chemical Company, Ltd.; poly (4,4'-isopropylidene-diphenylene) carbonate (also referred to as bisphenol-A-polycarbonate), poly(4,4'-cyclohexylidine diphenylene) carbonate (also referred to as bisphenol-Z-polycarbonate), poly(4,4'-isopropylidene-3,3'-dimethyl-diphenyl) carbonate (also referred to as bisphenol-C-polycarbonate), and the like, and mixtures thereof, and other known suitable polycarbonates.

Photoconductor Layer Examples

A number of known components can be selected for the various photoconductor layers, such as the supporting substrate, the photogenerating layer, the charge transport layer, the hole blocking layer when present, and the adhesive layer when present, such as those components as illustrated in the copending applications referenced herein.

The thickness of the photoconductor substrate layer depends on many factors, including economical considerations, electrical characteristics, adequate flexibility, availability, and cost of the specific components for each layer, and the like, thus this layer may be of a substantial thickness, for example about 3,000 microns, such as from about 1,000 to about 2,000 microns, from about 500 to about 1,000 microns, or from about 300 to about 700 microns ("about" throughout includes all values in between the values recited), or of a minimum thickness. In embodiments, the thickness of this layer is from about 75 to about 300 microns, or from about 100 to about 150 microns.

The photoconductor substrate may be opaque or substantially transparent, and may comprise any suitable material including known or future developed materials. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, gold, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired, and economical considerations. For a drum, this layer may be of a substantial thickness of, for example, up to many centimeters or of a minimum thickness of less than a millimeter. Similarly, a flexible belt may be of a substantial thickness of, for example, about 250 microns, or of a minimum thickness of less than about 50 microns provided there are no adverse effects on the final electrophotographic device.

In embodiments, where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, supporting substrate layers selected for the photoconductors of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

Examples of electrically conductive layers or ground plane layers usually present on nonconductive substrates are gold, gold containing compounds, aluminum, titanium, titanium/zirconium, and other known suitable know components. The thickness of the metallic ground plane is, for example, from about 10 to about 100 nanometers, from about 20 to about 50 nanometers, and more specifically, about 35 nanometers, and the titanium or titanium/zirconium ground plane is, for example, from about 10 to about 30 nanometers, and more specifically, about 20 nanometers in thickness.

An optional hole blocking layer when present is usually in contact with the ground plane, and can be comprised of a number of known components as illustrated herein, such as metal oxides, phenolic resins, aminosilanes, mixtures thereof, and the like.

Aminosilane examples included in the hole blocking layer can be represented by

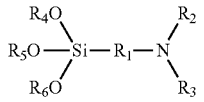

wherein $R_1$ is an alkylene group containing, for example, from 1 to about 25 carbon atoms; $R_2$ and $R_3$ are independently selected from the group consisting of at least one of hydrogen or alkyl containing, for example, from 1 to about 12 carbon atoms, and more specifically, from 1 to about 4 carbon atoms; aryl with, for example, from about 6 to about 42 carbon atoms, such as a phenyl group; and a poly(alkylene like ethylene amino) group; and $R_4$, $R_5$ and $R_6$ are independently selected from an alkyl group containing, for example, from 1 to about 10 carbon atoms, and more specifically, from 1 to about 4 carbon atoms.

Aminosilane specific examples include 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris(ethylethoxy)silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino)ethylamino]-3-proprionate, (N,N'-dimethyl 3-amino)propyl triethoxysilane, N,N-dimethylaminophenyl triethoxysilane, trimethoxysilyl propyldiethylene triamine, and the like, and mixtures thereof. Yet more specific aminosilane materials are 3-aminopropyl triethoxysilane (γ-APS), N-aminoethyl-3-aminopropyl trimethoxysilane, (N,N'-dimethyl-3-amino)propyl triethoxysilane, and mixtures thereof.

The aminosilane may be hydrolyzed to form a hydrolyzed silane solution before being added into the final undercoat coating solution or dispersion. During hydrolysis of the aminosilanes, the hydrolyzable groups, such as alkoxy groups, are replaced with hydroxyl groups. The pH of the hydrolyzed silane solution can be controlled to obtain excellent characteristics on curing, and to result in electrical stability. A solution pH of, for example, from about 4 to about 10 can be selected, and more specifically, a pH of from about 7 to about 8. Control of the pH of the hydrolyzed silane solution may be affected with any suitable material, such as generally organic or inorganic acids. Typical organic and inorganic acids include acetic acid, citric acid, formic acid, hydrogen iodide, phosphoric acid, hydrofluorosilicic acid, p-toluene sulfonic acid, and the like.

The hole blocking layer can, in embodiments, be prepared by a number of known methods, the process parameters being dependent, for example, on the photoconductor member desired. The hole blocking layer can be coated as a solution or a dispersion onto the supporting substrate or on to the ground plane layer by the use of a spray coater, dip coater, extrusion coater, roller coater, wire-bar coater, slot coater, doctor blade coater, gravure coater, and the like, and dried at from about 40° C. to about 200° C. for a suitable period of time, such as from about 1 minute to about 10 hours, under stationary conditions or in an air flow. The coating can be accomplished to provide a final coating thickness of, for example, from about 0.01 to about 30 microns, or from about 0.02 to about 5 microns, or from about 0.03 to about 0.5 micron after drying.

Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo) perylene, titanyl phthalocyanines, and the like, and more specifically, vanadyl phthalocyanines, Type V hydroxygallium phthalocyanines, high sensitivity titanyl phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 to about 10 microns, and more specifically, from about 0.25 to about 2 microns when, for example, the photogenerating compositions are present in an amount of from about 30 to about 75 percent by volume. The maximum thickness of this layer, in embodiments, is dependent primarily upon factors, such as photosensitivity, electrical properties, and mechanical considerations.

The photogenerating composition or pigment can be present in a resinous binder composition in various amounts inclusive of up to 100 percent by weight. Generally, however, from about 5 to about 95 percent by volume of the photogenerating pigment is dispersed in about 95 to about 5 percent by volume of the resinous binder, or from about 20 to about 30 percent by volume of the photogenerating pigment is dispersed in about 70 to about 80 percent by volume of the resinous binder composition. In one embodiment, about 90 percent by volume of the photogenerating pigment is dispersed in about 10 percent by volume of the resinous binder composition, and which resin may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly (vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like, hydrogenated amorphous silicon and compounds of silicon and germanium, carbon, oxygen, nitrogen, and the like fabricated by vacuum evaporation or deposition. The photogenerating layer may also comprise inorganic pigments of crystalline selenium and its alloys; Groups II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder, and fabricated by solvent coating techniques.

In embodiments, examples of polymeric binder materials that can be selected as the matrix or binder for the photogenerating layer are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly (phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene, acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like. These polymers may be block, random, or alternating copolymers.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 10 microns, or from about 0.2 to about 2 microns can be applied to or deposited on a supporting substrate, or on other surfaces in between the substrate and the charge transport layer, and the like. A charge blocking layer or hole blocking layer may optionally be applied to the electrically conductive supporting substrate surface prior to the application of a photogenerating layer. When desired, an adhesive layer may be included between the charge blocking, hole blocking layer or interfacial layer, and the photogenerating layer. Usually, the photogenerating layer is applied onto the supporting substrate or the blocking layer when it is present, and a charge transport layer or plurality of charge transport layers is formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary, and in embodiments is, for example, from about 0.05 to about 0.3 micron. The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As an optional adhesive layer or layers usually in contact with or situated between the hole blocking layer and the photogenerating layer, there can be selected various known substances inclusive of copolyesters, polyamides, poly(vinyl butyral), poly(vinyl alcohol), polyurethane, and polyacrylonitrile. This layer is, for example, of a thickness of from about 0.001 to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

A number of charge transport compounds can be included in the charge transport layer, which layer generally is of a thickness of from about 5 to about 75 microns, and more specifically, of a thickness of from about 10 to about 40 microns. Examples of charge transport components are aryl amines of the following formulas/structures

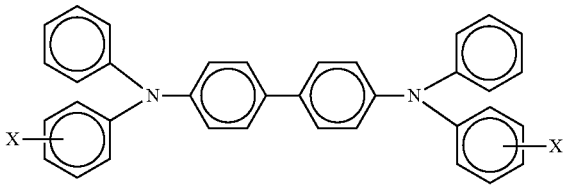

and

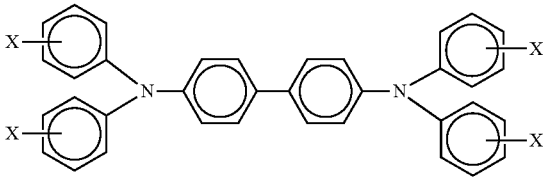

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

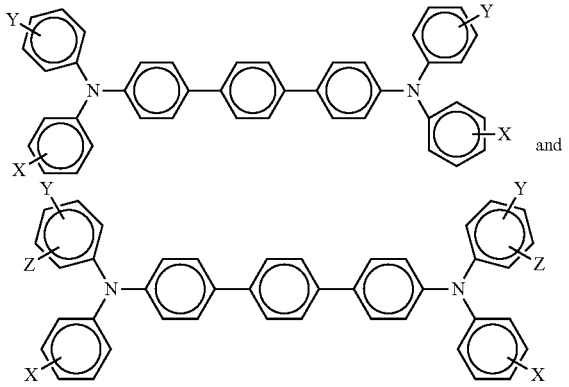

wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis (alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl) -N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and the like. Other known charge transport layer molecules can be selected reference for example, U.S. Pat. Nos. 4,921,773 and 4,464,450. the disclosures of which are totally incorporated herein by reference.

In addition to the compatible spirodilactam based polycarbonates, examples of additional binder materials selected for the charge transport layer or layers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene) carbonate (also referred to as bisphenol-A-polycarbonate), poly(4,4'-cyclohexylidine diphenylene) carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, electrically inactive binders are comprised of polycarbonate resins with a weight average molecular weight $M_w$ of from about 20,000 to about 100,000, or with a molecular weight $M_w$ of from about 50,000 to about 100,000. Generally, the transport layer contains from about 10 to about 75 percent by weight of the charge transport material, and more specifically, from about 35 to about 50 percent of this material.

The charge transport layer or layers, and more specifically, a first charge transport in contact with the photogenerating layer, and thereover a top or second charge transport overcoating layer, may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules present, for example, in an amount of from about 50 to about 75 weight percent, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4'-diamine, N,N'-bis(4-butylpheyl)-N,N'-di-m-tolyl-[p-erphenyl]-4,4'-diamine, N,N'-bis(4-butylphenyl)-N,N'-di-o-tolyl-[p-terpheny]-4,4'-diamine, N,N'-bis(4-butylpheny)-N,N'-bis-(4-isopropylphenyl)-[p-terpheny]-4,4'-diamine, N,N'-bis(4-butylphenyl)-N, N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine; hydrazones such as N-phenyl-N-methyl-3-(9-ethyl) carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments, to minimize or avoid cycle-up in equipment. such as printers with high throughput, the charge transport layer should be substantially free (less than about two percent) of di or triamino-triphenyl methane. A small molecule charge transporting compound that permits injection of holes into the photogenerating layer with high efficiency, and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine, or mixtures thereof. If desired, the charge transport material in the charge transport layer may comprise a polymeric charge transport material, or a combination of a small molecule charge transport material and a polymeric charge transport material.

Examples of components or materials optionally incorporated into the charge transport layers, or at least one charge transport layer to, for example, enable excellent lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NR, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2- methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20 weight percent, from about 1 to about 10 weight percent, or from about 3 to about 8 weight percent.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers, in embodiments, is from about 10 to about 70 microns, but thicknesses outside this range may, in embodiments, also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported to selectively discharge a surface charge present on the surface of the photoconductor. Typical application techniques include spraying, dip coating, roll coating, wire wound rod coating, and the like. Drying of the deposited coating may be effected by any suitable conventional technique, such as oven drying, infrared radiation drying, air drying, and the like. A known optional overcoating may be applied over the charge transport layer to provide abrasion protection.

In embodiments, the present disclosure relates to a photoconductive imaging member comprised of a titanium/zirconium containing ground plane layer, a hole blocking layer, a photogenerating layer, a polycarbonate charge transport layer, and an overcoating spirodilactam based polycarbonate containing charge transport layer as illustrated herein a photoconductive member with a photogenerating layer of a thickness of from about 0.1 to about 8 microns, and' at least one transport layer each of a thickness of from about 5 to about 100 microns; an imaging method and an imaging apparatus containing a charging component, a development component, a transfer component, and a fixing component, and wherein the apparatus contains a photoconductive imaging member comprised of a supporting substrate, a ground plane layer, a hole blocking layer, and thereover a photogenerating layer comprised of a photogenerating pigment, and a charge transport layer or layers, and thereover an overcoating charge transport layer, and where the transport layer is of a thickness of from about 40 to about 75 microns; a member wherein the photogenerating layer contains a photogenerating pigment present in an amount of from about 8 to about 95 weight percent; a member wherein the thickness of the photogenerating layer is from about 0.1 to about 4 microns; a member wherein the photogenerating layer contains a polymer binder; a member wherein the binder is present in an amount of from about 50 to about 90 percent by weight, and wherein the total of all layer components is about 100 percent; a member wherein the photogenerating component is a titanyl phthalocyanine or a hydroxygallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate, aluminized polyethylene naphthalate, titanized polyethylene terephthalate, titanized polyethylene naphthalate, titanized/zirconized polyethylene terephthalate. titanized/zirconized polyethylene naphthalate, goldized polyethylene terephthalate, or goldized polyethylene naphthalate; an imaging member wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating pigment is a metal free phthalocyanine; an imaging member wherein a single charge transport layer or where each of the charge transport layers comprises

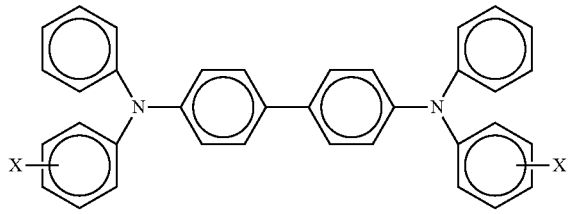

wherein X is selected from the group consisting of alkyl, alkoxy, aryl, and halogen; an imaging member wherein alkyl and alkoxy contains from about 1 to about 12 carbon atoms; an imaging member wherein alkyl contains from about 1 to about 5 carbon atoms; an imaging member wherein alkyl is methyl; an imaging member wherein each of, or at least one of the charge transport layers comprises

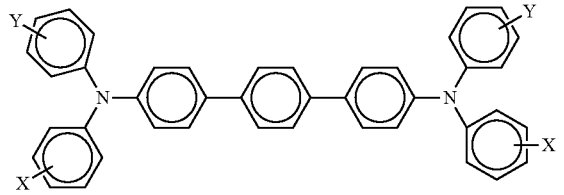

wherein X and Y are independently alkyl, alkoxy, aryl, a halogen. or mixtures thereof; an imaging member wherein alkyl and alkoxy for the charge transport component aryl amine contain from about 1 to about 12 carbon atoms; an imaging member wherein alkyl contains from about 1 to about 5 carbon atoms, and wherein the resinous binder is selected from the group consisting of polycarbonates and polystyrene; an imaging member wherein the photogenerating pigment present in the photogenerating layer is comprised of chlorogallium phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta)+/−0.2°) 7.4, 9.8, 12.4, 16.2, 17.6, 18.4, 21.9, 23.9, 25.0, 28.1 degrees, and the highest peak at 7.4 degrees; a method of imaging which comprises generating an electrostatic latent image on an imaging member developing the latent image, and transferring the developed electrostatic image to a suitable- substrate; a method of imaging wherein the imaging member is exposed to light of a wavelength of from about 370 to about 950 nanometers; a photoconductive member wherein the photogenerating layer is situated between the substrate and the charge transport; a member wherein the charge transport layer is situated between the substrate and the photogenerating layer; a member wherein the photogenerating layer is of a thickness of from about 0.1 to about 50 microns; a member wherein the photogenerating pigment is dispersed in from about 1 weight percent to about 80 weight percent of a polymer binder; a member wherein the photogenerating binder is present in an amount of from about 50 to about 90 percent by weight, and wherein the total of the layer components is about 100 percent; an imaging member wherein the photogenerating component is Type V hydroxygallium phthalocyanine, Type V titanyl phthalocyanine or chlorogallium phthalocyanine, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine. N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2.5-dimethylphenyl)-[p-terphenyl]-4,4'-diamine, N,N'-diphenyl-N,N'-bis(3-chlorophenyl)-[p-terphenyl]-4,4'-diamine molecules, and wherein the hole transport resinous binder is selected from the group consisting of polycarbonates and polystyrene; an imaging member wherein the photogenerating layer contains a metal free phthalocyanine; a photoconductor wherein the photogenerating layer contains an alkoxygallium phthalocyanine; photoconductive imaging members comprised of a supporting substrate, a photogenerating layer, a hole transport layer, and in embodiments wherein a plurality of charge transport layers are selected, such as for example, from two to about ten, and more specifically two, may be selected; and a photoconductive imaging member comprised of an optional supporting substrate, a photogenerating layer, and a first, second, and third charge transport layer.

In embodiments, the charge transport component can be represented by the following formulas/structures

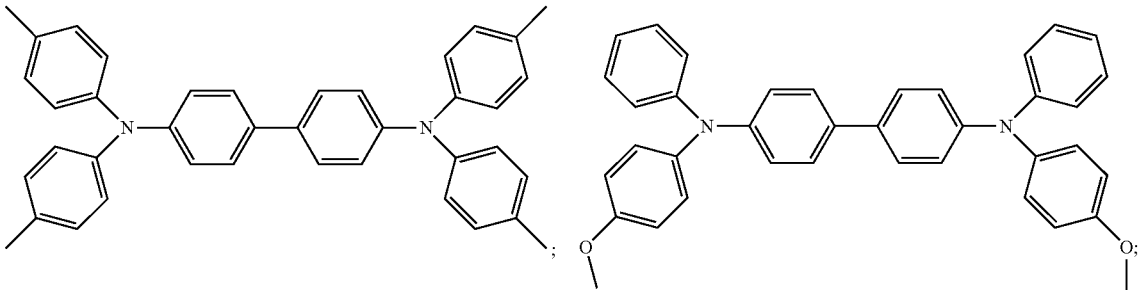

-continued

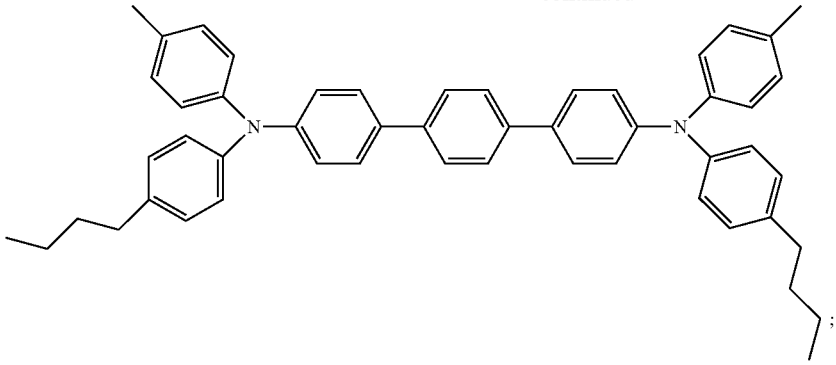

;

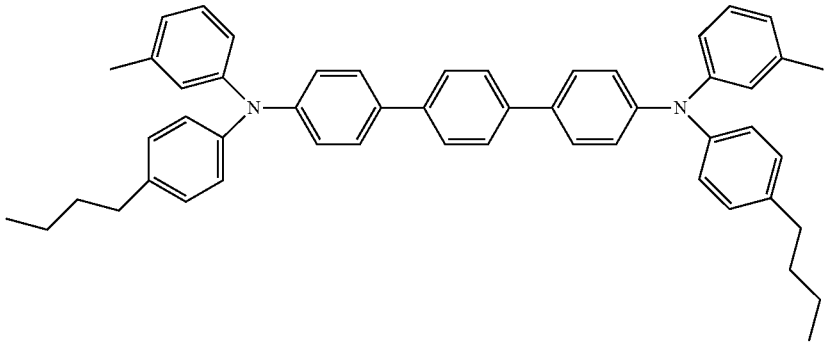

and

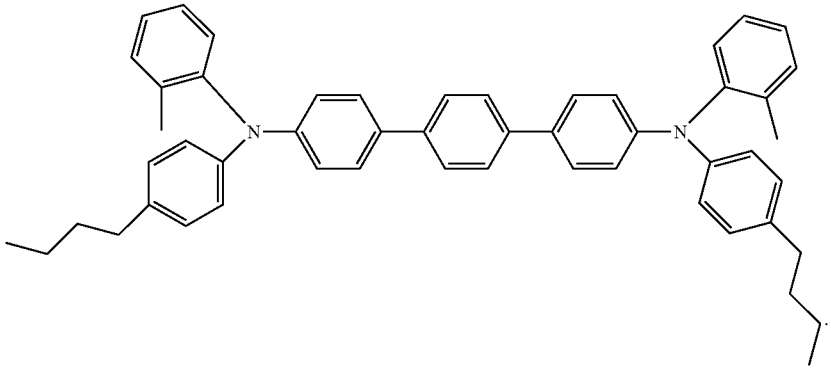

.

The following Examples are being submitted to illustrate embodiments of the present disclosure. Molecular weights were determined by Gel Permeation analysis.

COMPARATIVE EXAMPLE 1

On a 30 millimeter thick aluminum drum substrate, an undercoat layer was prepared and deposited thereon as follows.

Zirconium acetylacetonate tributoxide (35.5 parts), γ-aminopropyl triethoxysilane (4.8 parts), and poly(vinyl butyral) BM-S (2.5 parts) were dissolved in n-butanol (52.2 parts). The resulting solution was then coated by a dip coater on the above aluminum drum substrate, and the coating solution layer was preheated at 59° C. for 13 minutes, humidified at 58° C. (dew point=54° C.) for 17 minutes, and dried at 135° C. for 8 minutes. The thickness of the resulting undercoat layer was approximately 1.3 microns.

A photogenerating layer, 0.2 micron in thickness, comprising chlorogallium phthalocyanine (Type C) was deposited on the above undercoat layer. The photogenerating layer coating dispersion was prepared as follows. 2.7 Grams of chlorogallium phthalocyanine (ClGaPc) Type C pigment were mixed with 2.3 grams of the polymeric binder (carboxyl-modified vinyl copolymer, VMCH, available from Dow Chemical Company), 15 grams of n-butyl acetate, and 30 grams of xylene. The resulting mixture was mixed in an Attritor mill with about 200 grams of 1 millimeter Hi-Bea borosilicate glass beads for about 3 hours. The dispersion mixture obtained was then filtered through a 20 micron Nylon cloth filter, and the solids content of the dispersion was diluted to about 6 weight percent.

Subsequently, a 32 micron charge transport layer was coated on top of the above photogenerating layer from a solution prepared by dissolving N,N'-diphenyl-N,N-bis(3-methylphenyl)-1,1'-biphenyl-4,4'-diamine (mTBD, 4 grams), and a film forming polymer binder PCZ-400 [poly(4,4'-dihydroxy-diphenyl-1-1-cyclohexane, $M_w$=40,000)] available from Mitsubishi Gas Chemical Company, Ltd. (6 grams) in a solvent mixture of 21 grams of tetrahydrofuran (THF), and 9 grams of toluene, followed by drying in an oven at about 120° C. for about 40 minutes. The resulting charge transport layer PCZ-400/mTBD ratio was 60/40.

EXAMPLE I

A photoconductor was prepared by repeating the process of Comparative Example 1 except that a 32 micron thick charge transport layer was coated on top of the photogenerating layer from a solution prepared from N,N'-diphenyl-N,N-bis(3-methylphenyl)-1,1'-biphenyl-4,4'-diamine (4 grams), the film forming polymer binder PCZ-400 [poly(4,4'-dihydroxy-diphenyl-1-1-cyclohexane carbonate, $M_w$ =40,000)], available from Mitsubishi Gas Chemical Company, Ltd. (5.4 grams), a copolymer of a spirodilactam polycarbonate, and a polycarbonate, which copolymer was represented by

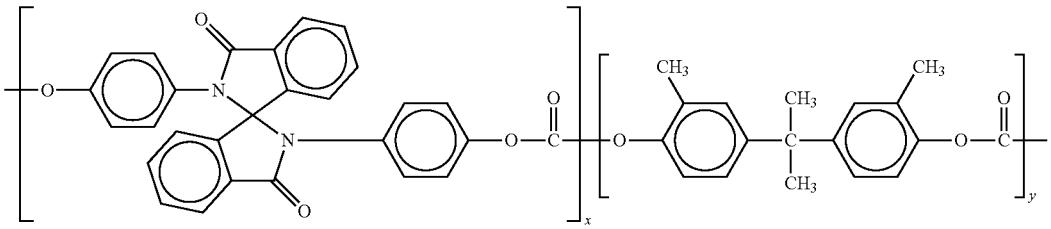

wherein x is equal to 6 mole percent, y is equal to 94 mole percent, and with a weight average molecular weight of 60,000 (0.6 gram), dissolved in a solvent mixture of 21 grams of tetrahydrofuran (THF), and 9 grams of toluene. The charge transport layer PCZ-400/spirodilactam polycarbonate copolymer/4,4'-diamine ratio was 54/6/40.

EXAMPLE II

A photoconductor is prepared by repeating the process of Comparative Example 1 except that a 32 micron thick charge transport layer is coated on top of the photogenerating layer from a solution prepared from N,N'-diphenyl-N,N-bis(3-methylphenyl)-1,1'-biphenyl-4,4'-diamine (4 grams), the film forming polymer binder PCZ-400[poly(4,4'-dihydroxy-diphenyl-1-1-cyclohexane carbonate, $M_w$ =40,000)], available from Mitsubishi Gas Chemical Company, Ltd. (5.4 grams), and a copolymer of a spirodilactam polycarbonate, and a polycarbonate, which copolymer is represented by, as obtained from Shell Development Company, Houston Tex.,

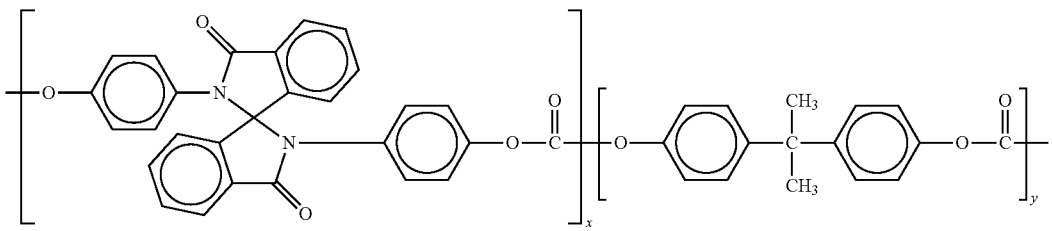

wherein x is equal to 10 mole percent, y is equal to 90 mole percent, and with a weight average molecular weight of 100,000(0.6 gram) dissolved in a solvent mixture of 21 grams of tetrahydrofuran (THF) and 9 grams of toluene. The charge transport layer PCZ-400/spirodilactam polycarbonate copolymer/4,4'-diamine ratio is 54/6/40.

EXAMPLE III

A photoconductor is prepared by repeating the process of Comparative Example 1 except that a 32 micron thick charge transport layer is coated on top of the photogenerating layer from a solution prepared from N,N'-diphenyl-N,N-bis(3-methylphenyl)-1,1'-biphenyl-4,4'-diamine (4 grams), the film forming polymer binder PCZ-400 [poly(4,4'-dihydroxy--diphenyl-1-1-cyclohexane carbonate, $M_w$ =40,000)], available from Mitsubishi Gas Chemical Company, Ltd. (5.4 grams), a copolymer of a spirodilactam polycarbonate, and a polycarbonate, which copolymer is represented by

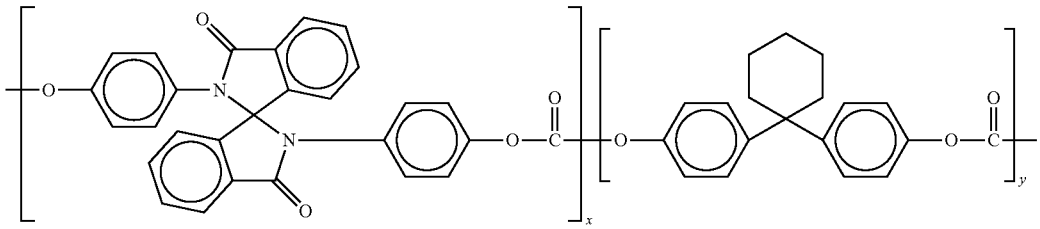

wherein x is equal to 20 mole percent, y is equal to 80 mole percent, and with a weight average molecular weight of 80,000 (0.6 gram) dissolved in a solvent mixture of 21 grams of tetrahydrofuran (THF), and 9 grams of toluene. The charge transport layer PCZ-400/spirodilactam polycarbonate copolymer/4,4'-diamine ratio is 54/6/40.

Electrical Property Testing

The above prepared photoconductors of Comparative Example 1 and Example I were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The above photoconductors were tested at surface potentials of 700 volts with the exposure light intensity incrementally increased by means of regulating a series of neutral density filters; and the exposure light source was a 780 nanometer light emitting diode. The xerographic simulation was completed in an environmentally controlled light tight chamber at ambient conditions (40 percent relative humidity and 22° C.).

Substantially similar PIDCs were obtained for the above two photoconductors. Therefore, the incorporation of the above copolymer of a spirodilactam polycarbonate and a polycarbonate into the charge transport layer did not adversely affect the electrical properties of the Example I photoconductor.

Wear Testing

Wear tests of the photoconductors of Comparative Example 1 and Example I were performed using an in-house wear test fixture (biased charging roll, BCR charging, and peak to peak voltage of 1.45 kilovolts). The total thickness of each photoconductor was measured by a Permascope before each wear test was initiated. Then the photoconductors were separately placed into the wear fixture for 50 kilocycles. The total photoconductor thickness was measured again with the Permascope, and the difference in thickness was used to calculate wear rate (nanometers/kilocycle) of the photoconductors. The smaller the wear rate, the more wear resistant was the photoconductor. The wear rate data is summarized in Table 1.

TABLE 1

| | Wear Rate (Nanometers/Kilocycle) |
|---|---|
| Comparative Example 1 | 58 |
| Example I | 38 |

The photoconductor of Example I exhibited an about 40 percent lower wear rate than the photoconductor of Comparative Example 1 (38 nanometers/kilocycle for the Example I photoconductor versus 58 nanometers/kilocycle for the Comparative Example 1 photoconductor). Incorporation of the spirodilactam polycarbonate copolymer into the charge transport layer thus reduced the wear rate.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a supporting substrate, a photogenerating layer, and a charge transport layer, and wherein said charge transport layer contains a spirodilactam polycarbonate copolymer binder.

2. A photoconductor in accordance with claim 1 wherein said copolymer is represented by the following

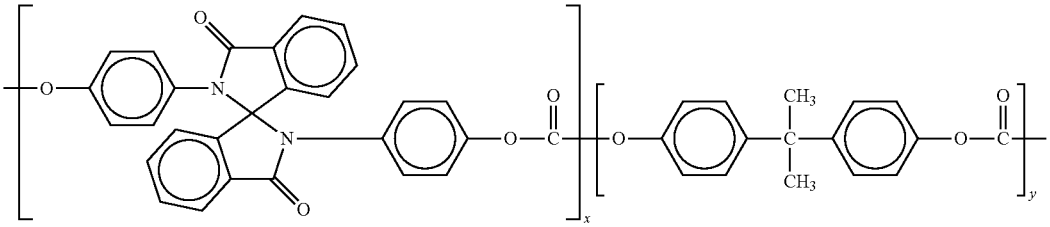

and wherein x and y represent mole percents, and where the sum thereof is about 100 mole percent, and where said charge transport layer further includes a second binder of a polycarbonate.

3. A photoconductor in accordance with claim 2 wherein x is from about 1 to about 30 mole percent, y is from about 70 to about 99 mole percent; and said charge transport layer is comprised of a hole transport component, said spirodilactam polycarbonate copolymer, and said polycarbonate.

4. A photoconductor in accordance with claim 2 wherein said second polycarbonate binder is poly(4,4'-dihydroxy-diphenyl-1-1-cyclohexane) carbonate, poly(4,4'-isopropylidene-diphenylene) carbonate, poly(4,4'-cyclohexylidine diphenylene) carbonate, or poly (4,4'-isopropylidene-3,3'-dimethyl-diphenyl) carbonate.

8. A photoconductor in accordance with claim 2 wherein said spirodilactam copolymer is present in an amount of from about 2 to about 10 weight percent, and said second polycarbonate binder is present in an amount of from about 40 to about 60 weight percent.

9. A photoconductor in accordance with claim 2 wherein said charge transport layer is comprised of a first charge transport layer in contact with said photogenerating layer, and a second charge transport layer in contact with said first charge transport layer, and wherein said spirodilactam copolymer, and said second polycarbonate binder are present in said second charge transport layer.

10. A photoconductor in accordance with claim 2 wherein said spirodilactam copolymer is represented by one of the following

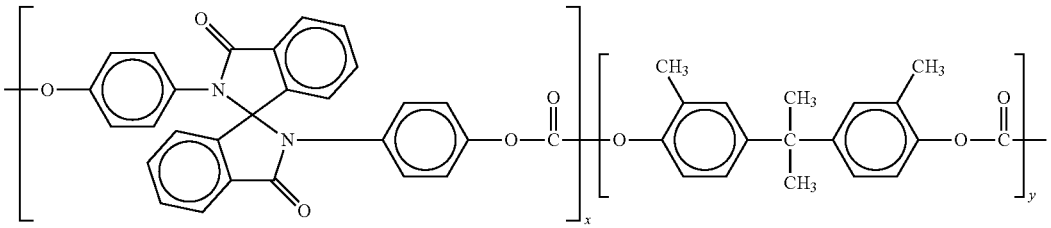

or

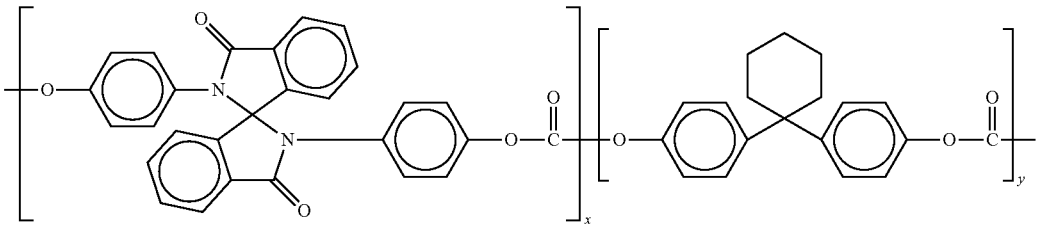

5. A photoconductor in accordance with claim 2 wherein for said spirodilactam copolymer x is from about 2 to about 20 mole percent, and y is from about 80 to about 98 mole percent, and wherein the total thereof is 100.

6. A photoconductor in accordance with claim 2 wherein said spirodilactam copolymer possesses a weight average molecular weight of from about 25,000 to about 200,000, and a number average molecular weight of from about 20,000 to about 150,000.

7. A photoconductor in accordance with claim 2 wherein said spirodilactam copolymer is present in an amount of from about 1 to about 20 weight percent of the charge transport layer components.

wherein x and y represent mole percents, and where the sum thereof is 100 mole percent; wherein said x is a number between about 2 and about 10, and said y is a number of from between about 90 and about 98, and said charge transport layer is comprised of said copolymer, aryl amines, and said second polycarbonate of poly(4,4'-dihydroxy-diphenyl-1-1-cyclohexane carbonate, poly(4,4'-isopropylidene-diphenylene) carbonate, poly(4,4'-cyclohexylidine diphenylene) carbonate or poly(4,4'-isopropylidene-3,3'-dimethyl-diphenyl) carbonate.

11. A photoconductor in accordance with claim 2 wherein said spirodilactam copolymer present in an amount of from about 2 to about 20 weight percent is represented by the following formulas/structures

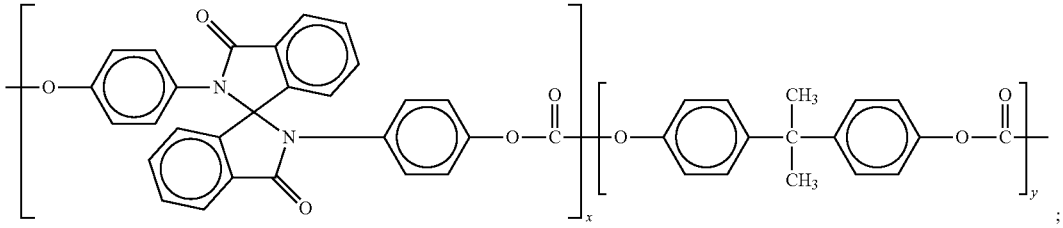

;

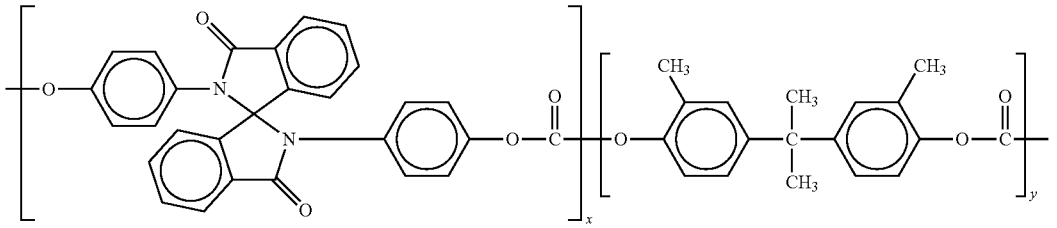

or

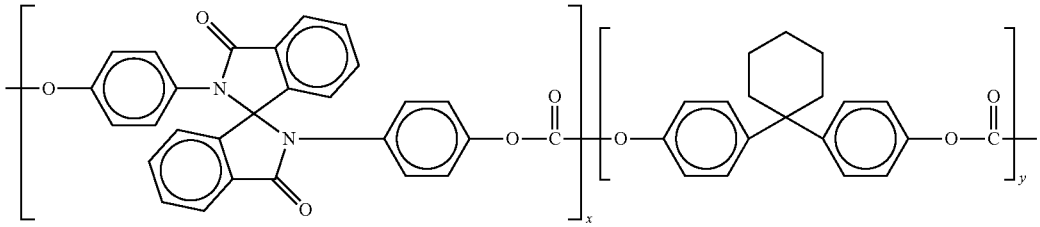

wherein x and y represent the mole percents, and where the sum thereof is 100 mole percent, and said second polycarbonate binder is poly(4,4'-dihydroxy-diphenyl-1-1-cyclohexane carbonate, poly(4,4'-isopropylidene-diphenylene) carbonate, poly(4,4'-cyclohexylidine diphenylene) carbonate, or poly(4,4'-isopropylidene-3,3'-dimethyl-diphenyl) carbonate each present in an amount of from about 45 to about 65 weight percent.

12. A photoconductor in accordance with claim 2 wherein said second polycarbonate binder is poly(4,4'-dihydroxy-diphenyl-1-1-cyclohexane) carbonate, poly(4,4'-isopropylidene-diphenylene) carbonate, poly(4,4'-cyclohexylidine diphenylene) carbonate, or poly(4,4'-isopropylidene-3,3'-dimethyl-diphenyl) carbonate; said charge transport layer includes

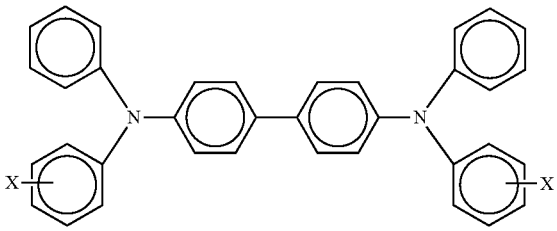

-continued

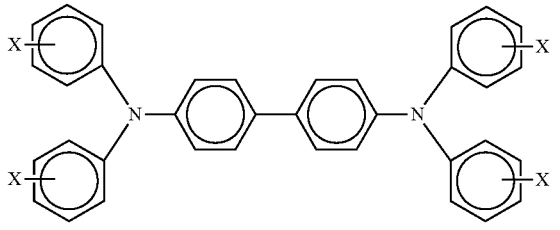

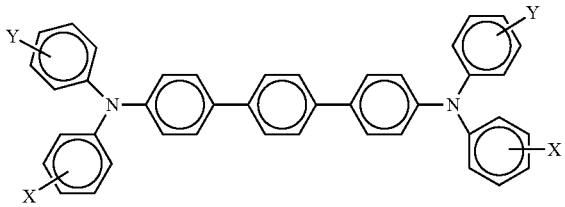

or

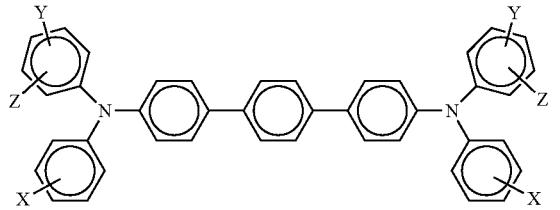

wherein X, Y, and Z are independently selected from the group consisting of alkyl, alkoxy, aryl, halogen, and mixtures thereof, and x and y of said copolymer are from about 40 to about 60 mole percent.

13. A photoconductor in accordance with claim 2 wherein said charge transport layer includes a component selected from the group consisting of N,N'-bis(methylphenyl)-1,1-biphenyl-4,4'-diamine, tetra-p-tolyl-biphenyl-4,4'-diamine, N,N'-diphenyl-N,N'-bis(4- methoxyphenyl) -1,1-biphenyl-4,4'-diamine, N,N'-bis(4-butylphenyl)-N,N'-di-p-tolyl-[p-terphenyl)]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl) -[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl) -[p-terpheny]-4,4'-diamine, and wherein x and y of said copolymer are from about 40 to about 60 mole percent.

14. A photoconductor in accordance with claim 2 wherein said photogenerating layer is comprised of at least one photogenerating pigment.

15. A photoconductor in accordance with claim 14 wherein said photogenerating pigment is comprised of at least one of a titanyl phthalocyanine, a hydroxygallium phthalocyanine, a halogallium phthalocyanine, a bisperylene, and mixtures thereof, said x is from about 1 to about 30 mole percent, and said y is from about 70 to about 99 mole percent.

16. A photoconductor in accordance with claim 2 wherein said photogenerating layer is comprised of at least one photogenerating pigment and a resin binder; and wherein said photogenerating layer is situated between said substrate and said charge transport layer.

17. A photoconductor in accordance with claim 2 further including in said charge transport layer an antioxidant comprised of at least one of a hindered phenolic and a hindered amine.

18. A photoconductor in accordance with claim 2 further including a hole blocking layer, and an adhesive layer, wherein the hole blocking layer is in the form of a coating in contact with the supporting substrate, and the adhesive layer is in the form of a coating in contact with the hole blocking layer.

19. A photoconductor in accordance with claim 2 wherein the ratio of said second polycarbonate binder to said spirodilactam polycarbonate to a said charge transport layer of N,N'-diphenyl-N,N-bis(3-methvlphenyl)-1,1'-biphenyl-4,4'-diamine is 54/6/40.

20. A photoconductor in accordance with claim 2 wherein said second polycarbonate is poly(4,4'-dihydroxy-diphenyl-1-1-cyclohexane) carbonate, and said copolymer is represented by

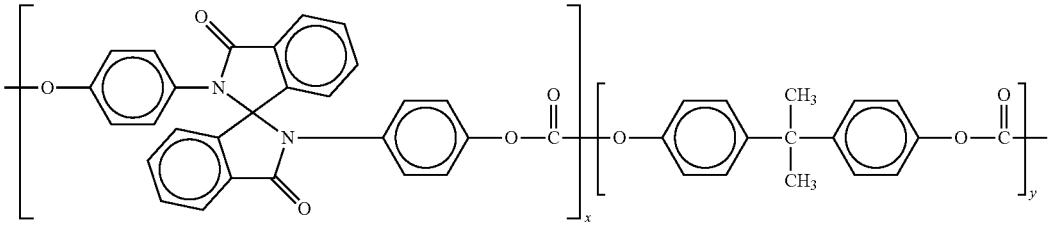

wherein x is equal to 6 mole percent, y is equal to 94 mole percent, and said charge transport layer includes an aryl amine.

21. A photoconductor in accordance with claim 1 wherein said charge transport layer is comprised of a hole transport component, said spirodilactam copolymer as a first resin binder, a polycarbonate second resin binder, and which photoconductor further contains a hole blocking layer in contact with said substrate and an adhesive layer in contact with said hole blocking layer.

22. A photoconductor in accordance with claim 21 wherein said polycarbonate second resin binder is a polycarbonate Z or a polycarbonate A present in an amount of from about 40 to about 60 weight percent.

23. A photoconductor in accordance with claim 1 further including a hole blocking layer, and an adhesive layer, and wherein said charge transport layer contains a charge transport component, said spirodilactam polycarbonate binder, and a second polycarbonate dissimilar than said spirodilactam polycarbonate, and wherein said spirodilactam polycarbonate is represented by the following

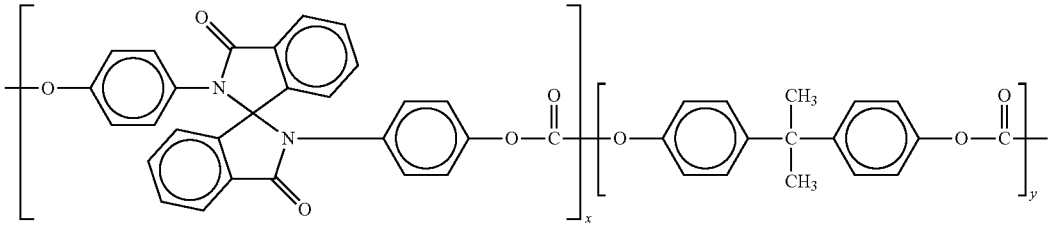

;

-continued

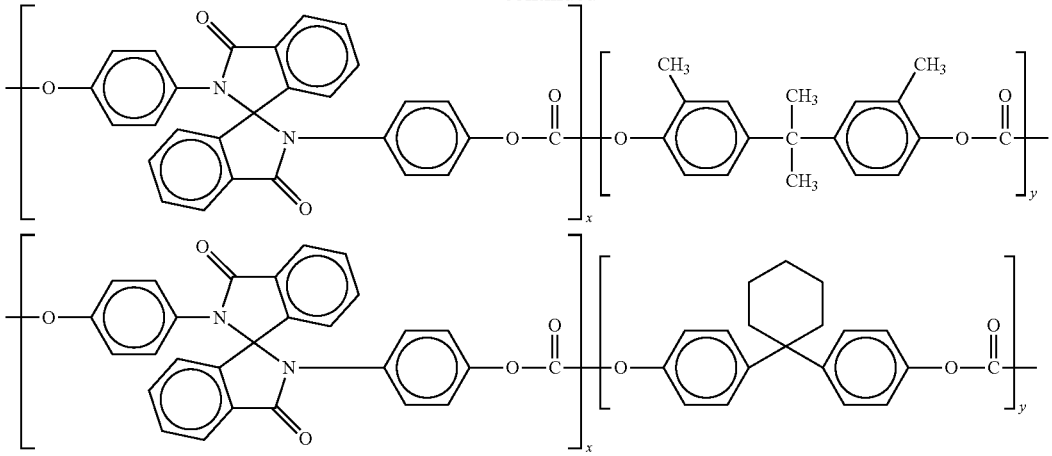

or wherein x and y represent mole percents, and where the sum thereof is 100 mole percent, and which spirodilactam is present in an amount of from about 3 to about 12 weight percent.

proprionate, (N,N'-dimethyl 3-amino)propyl triethoxysilane, N,N-dimethylaminophenyl triethoxysilane, trimethoxysilyl propyldiethytene triamine, and mixtures thereof, said spirodilactam polycarbonate is of the following formulas/structures

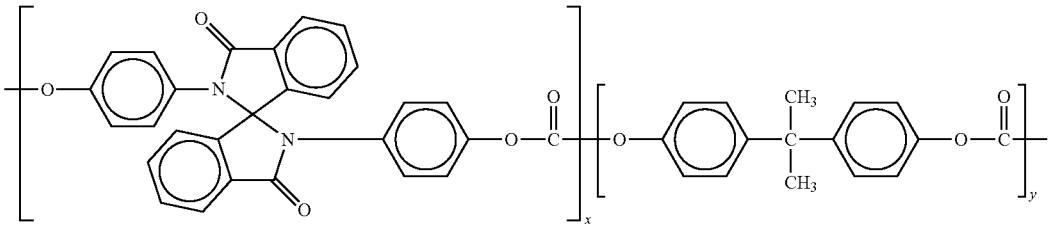

24. A photoconductor in accordance with claim 23 wherein the ratio of said second polycarbonate to said spirodilactam polycarbonate to said charge transport layer component is 54/6/40.

25. A photoconductor in accordance with claim 1 wherein said spirodilactam polycarbonate copolymer is a polycarbonate copolymer of said spirodilactam, and a bisphenol selected from the group consisting of bisphenol A and bisphenol Z.

26. A photoconductor comprised in sequence of a supporting substrate, a hole blocking layer thereover, an adhesive layer, a photogenerating layer, and a charge transport layer, and wherein said charge transport layer contains a charge transport component, a spirodilactam polycarbonate present in an amount of from about 1 to about 20 weight percent, and a polycarbonate present in an amount of from about 40 to about 65 weight percent.

27. A photoconductor in accordance with claim 26 wherein said hole blocking layer is comprised of an aminosilane of at least one of 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris (ethylethoxy)silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino)ethylamino]-3- wherein said x is a number of from between about 2 and about 10, and said y is a number of from between about 90 and about 98, and said polycarbonate present in an amount of from about 40 to about 65 weight percent is selected from the group consisting of poly(4,4'-dihydroxy-diphenyl-1-1-cyclohexane) carbonate, poly(4,4'-isopropylidene-diphenylene) carbonate, poly(4,4'-cyclohexylidine diphenylene) carbonate, and poly(4,4'-isopropylidene-3,3'-dimethyl-diphenyl) carbonate.

28. A photoconductor in accordance with claim 26 wherein said hole blocking layer is comprised of an aminosilane represented by

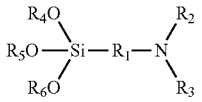

wherein $R_1$ is an alkylene; $R_2$ and $R_3$ are alkyl, hydrogen, or aryl, and each $R_4$, $R_5$ and $R_6$ is alkyl.

29. A photoconductor in accordance with claim 26 wherein said spirodilactam polycarbonate is present in an amount of from about 3 to about 10 weight percent.

30. A photoconductor comprised of a photogenerating layer comprised of a photogenerating pigment, a hole blocking layer, an adhesive layer, and a charge transport layer, and wherein said charge transport layer is comprised of a charge transport component, a spirodilactam polycarbonate copolymer represented by

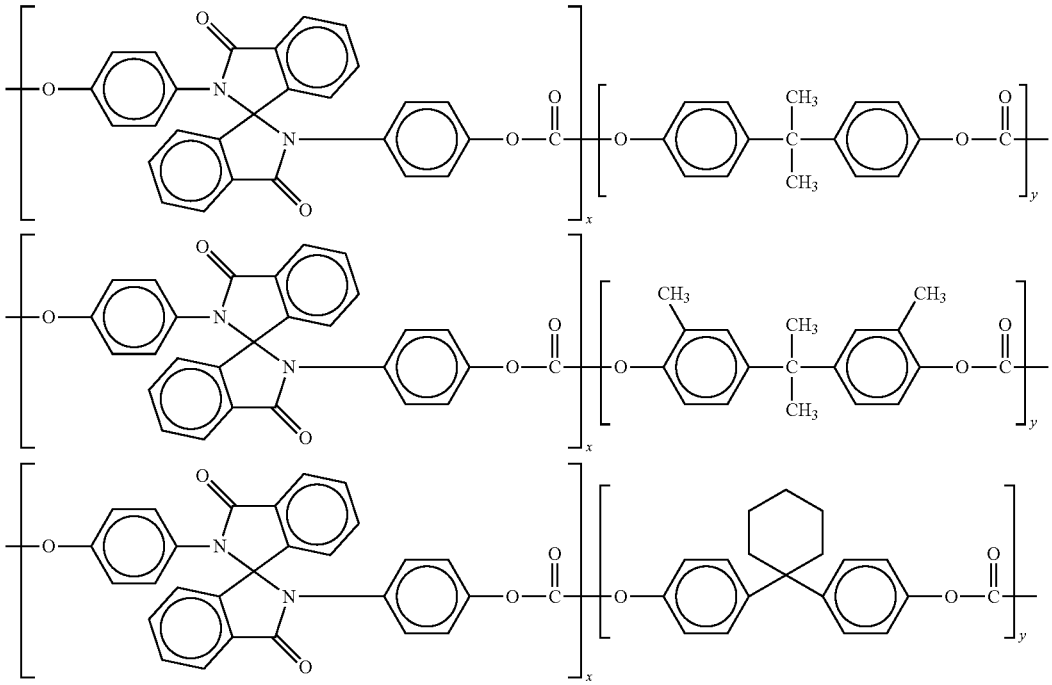

;

or wherein x and y represent mole percents, and where the sum of x and y thereof is 100 mole percent, and a polycarbonate selected from the group consisting of poly(4,4'-dihydroxy-diphenyl-1-1-cyclohexane) carbonate, poly(4,4'-isopropylidene-diphenyl) carbonate, and mixtures thereof.

31. A photoconductor in accordance with claim 30 wherein said spirodilactam polycarbonate is present in an amount of from about 1 to about 20 weight percent.

32. A photoconductor in accordance with claim 30 wherein said spirodilactam polycarbonate is present in an amount of from about 3 to about 15 weight percent, and said polycarbonate selected from the group consisting of poly(4,4'-dihydroxy-diphenyl-1-1- cyclohexane) carbonate, poly(4,4'-isopropylidene-diphenyl) carbonate, and mixtures thereof is present in an amount of from about 40 to about 70 weight percent.

* * * * *